United States Patent [19]

Triner et al.

[11] Patent Number: 4,752,246

[45] Date of Patent: Jun. 21, 1988

[54] PRELOADED SPRING CONTACT ELECTRICAL TERMINAL

[75] Inventors: Irvin R. Triner, Stickney; John M. Yun, Oak Brook, both of Ill.

[73] Assignee: Molex Incorporated, Lisle, Ill.

[21] Appl. No.: 75,183

[22] Filed: Jul. 17, 1987

Related U.S. Application Data

[63] Continuation of Ser. No. 868,495, May 30, 1986, abandoned.

[51] Int. Cl.[4] ..... H01R 13/04

[52] U.S. Cl. ..... 439/682

[58] Field of Search ..... 439/682, 79; 439/660, 439/692, 695, 696, 629–634, 636, 637

[56] References Cited

U.S. PATENT DOCUMENTS 2,938,190 5/1960 Krehbiel ..... 439/682

3,854,788 12/1974 Goodman ..... 339/176 M 4,150,863 4/1979 Krafthefer et al. ..... 339/192 R

FOREIGN PATENT DOCUMENTS 2079071 1/1985 United Kingdom .

*Primary Examiner*—Joseph M. McGlynn

*Attorney, Agent, or Firm*—John W. Cornell; Louis A. Hecht

[57] ABSTRACT

A preloaded spring contact electrical terminal with a support portion mounted in a fixed position in a housing, an abutment portion and a spring flex portion deformed to preload the abutment portion against a housing cavity wall. A contact portion is axially aligned with and axially spaced from the abutment portion to provide a narrow configuration in which preload force, contact force and insertion force can be optimized while contact wear is reduced.

4 Claims, 1 Drawing Sheet

PRELOADED SPRING CONTACT ELECTRICAL TERMINAL

This application is a continuation of application Ser. No. 868,495 filed May 30, 1986, now abandoned.

BACKGROUND OF THE INVENTION

1. Field of the Invention

The present invention relates to electrical terminals and more particularly to a preloaded spring contact terminal of the type received in a connector housing cavity for making electrical contact to a contact member inserted into the housing cavity.

2. Brief Description of the Prior Art

Many preloaded spring contact electrical terminals have been provided in the past for making electrical contact to contact members such as terminal pins, circuit board edge conductor pads and others. Known terminals of this character are typically received within cavities provided in an electrical connector housing. When the contact member is inserted, it engages a contact portion of the terminal. Preloading of a terminal by resilient deformation increases the contact force applied to an inserted contact member.

U.S. Pat. No. 3,697,926 discloses a preloaded spring contact terminal of a type which has been successful in the marketplace. This terminal is received in a connector housing cavity with a base or support portion engaging one cavity wall and with a spaced portion engaging an opposed cavity wall. An intermediate portion acts as a flex spring and is deformed when the terminal is inserted into the cavity in order to provide a preload force with which the spaced portion is biased against the opposed cavity wall. When a contact member is inserted (see FIGS. 7–9) the terminal is further deformed and the spring flex portion applies a contact force to the contact member.

For some purposes, terminals of the type disclosed in U.S. Pat. No. 3,697,926 have disadvantages. One difficulty when small terminals are used in connectors with small center-to-center spacings is that the insertion forces to be overcome when a contact member is inserted are undesirably large and relatively large in comparison with the withdrawal force. Another disadvantage is that a single portion of the terminal functions not only as the contact portion, but also as the abutment portion in engagement with a cavity wall to provide the preload force. This prevents the use of relatively high contact forces because of resulting high insertion forces and unfavorable mechanical advantage as the contact member is inserted. In addition, this configuration results in substantial wiping action at the contact region leading to undesirable wear of the contact portion of the terminal.

United Kingdom Patent No. GB 2079071B discloses an example of a different type of preloaded spring contact terminal. The contact portion of the terminal engageable with an inserted contact member is at a different location than the abutment portion of the terminal engageable with a cavity wall to provide the preload force. The contact portion and the abutment portions are spaced from one another in a direction transverse to the axial direction of contact member insertion. A difficulty with this arrangement is that the terminal is required to be significantly wider than the inserted contact member making close center-to-center spacings difficult to achieve. In addition, a terminal having excessive width is not well adapted to a stamping die progression in which the center-to-center spacing is equal to the center-to-center spacing of cavities of a terminal housing.

SUMMARY OF THE INVENTION

Among the important objects of the present invention are to provide an improved preloaded spring contact electrical terminal; to provide a preloaded terminal in which high contact forces can be attained without unduly large insertion forces; to provide a preloaded terminal in which the contact forces and insertion forces can readily be tailored for different applications; to provide a preloaded terminal in which contact wear due to wiping action is reduced; to provide a terminal well adapted for close center-to-center dimensions in connectors having dense circuit patterns; to provide a preloaded terminal capable of being formed in a stamping die progression with small center-to-center dimensions; to provide a preloaded terminal having a low ratio of insertion force to withdrawal force; and to provide a preloaded spring contact electrical terminal of novel configuration overcoming disadvantages of those used in the past.

The above and other objects of the present invention are achieved by providing a preloaded spring contact electrical terminal adapted to be mounted in a connector housing cavity having cavity walls extending axially from a cavity entrance. A contact member is removably insertable into the cavity through the entrance to be electrically contacted by the terminal. The terminal includes a support portion mounted in a fixed position in the housing and an abutment portion engageable with one of the cavity walls. A spring flex portion of the terminal is normally deformed to preload the abutment portion against the cavity wall. When a contact member is inserted, the spring flex portion is further deformed to provide a contact force larger than the preload force.

The terminal of the present invention is characterized by having a contact portion within the cavity. The contact portion is axially aligned with the abutment portion, and is axially spaced from the abutment portion. In its normal condition, the contact portion is spaced from the one cavity wall by a distance less than the thickness of the insertable contact member.

BRIEF DESCRIPTION OF THE DRAWING

The present invention may be best understood from the following detailed description of a preferred embodiment illustrated in the accompanying drawing, wherein.

DETAILED DESCRIPTION OF THE PREFERRED EMBODIMENT

Figure 1:
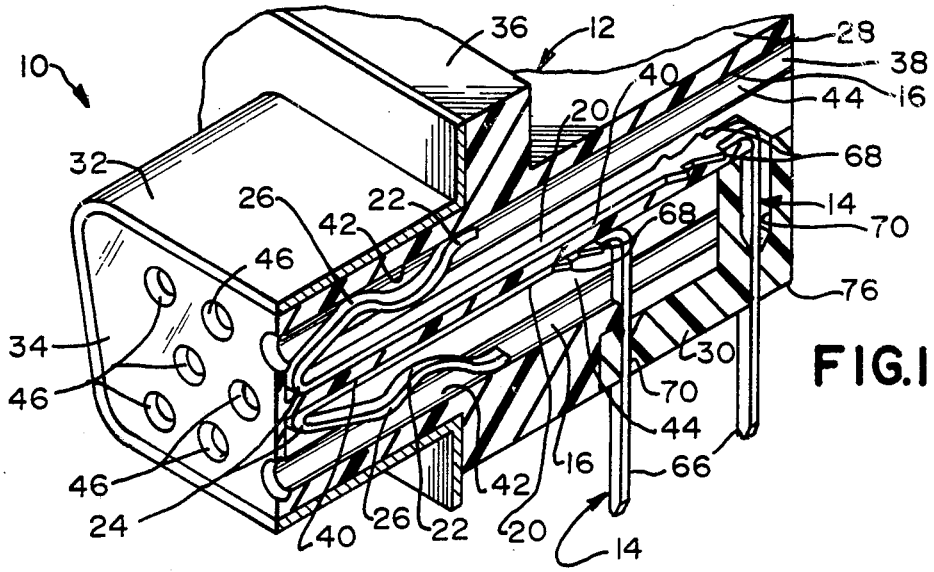
FIG. 1 is a fragmentary perspective view, partly in section, of an electrical connector including preloaded spring contact terminals embodying the present invention.

Having reference now to the drawing, there is illustrated an electrical connector generally designated by the reference numeral 10 including a housing 12 and a number of preloaded spring contact electrical terminals each generally designated as 14 and constructed in accordance with the principles of the present invention. Terminals 14 are mounted in cavities 16 of housing 12 in order to make electrical contact with contact members (FIG. 3) inserted into cavities 16.

Each terminal 14 includes a support portion 20 held in a fixed position in housing 12, an abutment portion 22 normally engaging a wall of cavity 16 and a spring flex portion 24 normally deformed to provide a preload force. In accordance with the invention, each terminal 14 also includes a contact portion 26 that is both axially aligned with and axially spaced from the abutment portion 22 in the axial direction of contact member insertion.

In the embodiment of the invention illustrated in the accompanying drawing, connector 10 is of the type known as a D-subminiature receptacle intended for mounting upon a circuit board (not shown). Connector 10 is releaseably connected to a mating connector (not shown) that may be associated with a wiring harness or the like. However, it should be understood that terminals constructed in accordance with the principles of the present invention may be used with connectors of many different sizes, types and configurations.

Connector housing 12 includes a connector body 28, a pin guide member 30 and a shell 32. Body 28 and member 30 are preferably formed as one-piece, molded parts of an electrically insulating plastic material. A nose portion 34 of body 28 is adapted to be received in a corresponding socket portion of a mating terminal (not shown) with which the contact members 18 are associated. A flange portion 36 separates the nose portion 34 from a rear portion 38 of body 28 and limits insertion of contact members 18 by providing a stop for the mating connector. Shell 32 is formed of electrically conductive metal and is received over the nose portion 34 and part of flange portion 36 to provide a ground plane or shield around the contact area of terminals 14.

Numerous cavities 16 are provided in a relatively dense configuration in body 28. Each cavity 16 includes a base wall 40, an opposed wall 42 and side walls 44. Each cavity extends continuously through the axial dimension of the body 28 from the rear portion 38 through the nose portion 34 to a cavity entrance opening 46 through which the contact members 18 are received. Side walls 44 may be stepped as illustrated at 48 to accommodate contact members 18 wider than the terminals 14.

Figure 2:
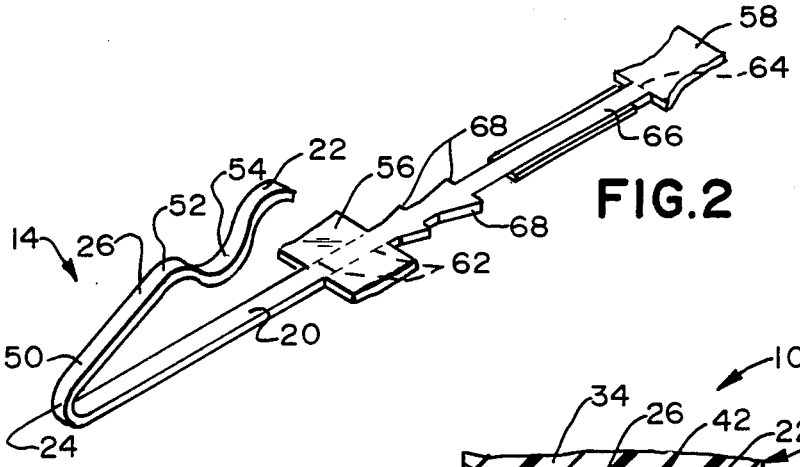
FIG. 2 is a perspective view of a terminal of the present invention shown prior to insertion into an electrical connector housing and including segments of carrier strips removed prior to and/or during the insertion process.

As illustrated in FIG. 2, terminals 14 are preferably made by means of progressive stamping and forming operations from a blank of sheet metal stock. The support portion 20, abutment portion 22, spring flex portion 24 and contact portion 26 are formed as segments of a single, one-piece, continuous strip of metal aligned perpendicular to the longitudinal direction of the sheet metal stock. As a result, the width of terminal 14 may be very small, permitting close center-to-center spacing of terminals 14 in the connector 10.

Support portion 20 of each terminal 14 lies in the flat plane of the stock. Spring flex portion 24 has an arcuate shape provided by bending the strip of metal. Contact portion 26 includes a generally flat lead-in region 50 terminating in a rounded or arcuate final contact region 52. A spacer portion 54 in the form of a reverse bend interconnects the contact portion 26 with the abutment portion 22 which also has an arcuate or rounded configuration.

In the illustrated embodiment of the invention, the spring flex portion 24 is formed by a bend of more than 90° so that the contact portion 26 and the abutment portion 22 overlie the support portion 20. In the relaxed configuration of the formed terminal 14 shown in FIG. 2, the thickness or distance between the abutment portion 22 and support portion 20 is greater than the thickness of cavities 16, this being the distance between the cavity base wall 40 and opposed wall 42. As a result, as a terminal 14 is inserted into a cavity 16 through the rear portion 38 of body 28, the spring flex portion 24 is deformed to hold the support portion 20 against base wall 40 and to hold the abutment portion 22 against the opposed wall 42 with a preload spring force.

Prior to insertion of terminals 14 into cavities 16, the terminals are preferably interconnected in closely spaced, parallel relationship by carrier strips 56 and 58 formed from the original sheet metal stock. This permits economical gang assembly of terminals with the connector housing 12. Since the width requirements of terminals 14 are extremely small, the terminals can be provided in strips with the same center-to-center spacing as cavities 16.

Prior to or during initial insertion of a number of terminals 14 simultaneously into a number of aligned cavities 16, carrier strip 56 is severed from each terminal 14 along lines 62 illustrated in FIG. 2. After the terminals 14 are fully inserted, carrier strip 58 may be removed along line 64.

Extending rearwardly from support portion 20 of each terminal 14 is a tail or pin contact portion 66. Other contact types, such as surface mount contacts, may be employed. Initially, pin portions 66 are coplanar with support portions 20 in the plane of the stock from which the terminals 14 are made. In the region between support portions 20 and pin portions 66, each terminal 14 is provided with barbs 68 for engagement with cavity side walls 44 for securing the terminals in place in the connector body 28.

After the terminals 14 have been mass inserted into side by side cavities 16 of the housing 12, the pin portions 66 are bent downward generally at right angles so that the pin portions 66 are arrayed in a pattern corresponding to an array of contact pin receiving holes provided in a circuit board (not shown) upon which the connector 10 is to be mounted. After this forming operation, the pin guide member 30 of housing 12 is assembled with the connector body 28. The pin guide member 30 includes an array of alignment and support holes 70 receiving pin contact portions 66. In its assembled position, the pin guide member 30 can be secured to the body portion 28 in any desired manner such as by friction or through the use of a suitable latch arrangement. The array of guide holes 70 accurately matches the array of pin receiving holes in a circuit board. As the pin guide member 30 of housing 12 is assembled, each pin contact portion 66 is held in a final position precisely corresponding to the hole pattern of the printed circuit board. As a result, the requirement for precise bending or forming of pin contact portions 66 is avoided.

Body 28 is provided with downwardly extending spacers 72 (FIG. 3), and the shell 32 may include a similar downwardly extending flange portion 74. Elements 72 and 74 hold bottom wall 76 of the connector body 28 in spaced relation to a printed circuit board to prevent wicking of solder when pin contact portions 66 are connected by a soldering operation to conductive regions of the circuit board.

Figure 4:
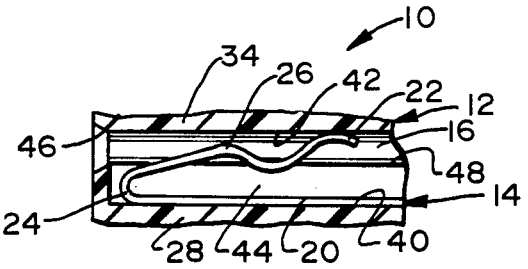
FIG. 4 is a fragmentary sectional view similar to part of FIG. 3 illustrating a terminal in a normal or initial position prior to insertion of a contact member.

The normal or initial configuration of terminals 14 in cavities 16 prior to insertion of a contact member 18 is shown in FIGS. 1 and 4. In this position, the support portion 20 is held in a fixed position engaging the cavity base wall 40. Spring flex portion 24 is deformed to force abutment portion 22 against opposed wall 42 with a predetermined preload force. Contact portion 26 is spaced away from the opposed wall 42 by a distance less than the thickness (the vertical direction as illustrated in FIG. 3) of the contact members 18.

When a contact member 18 is inserted through a cavity entrance 46 into one of the cavities 16, an electrical contact is made between the contact member 18 and the contact portion 26 of the corresponding terminal. During the insertion process, the leading end of the contact member 18 first engages the lead-in portion 50 of the contact portion 26. A camming action takes place as the contact member 18 is further inserted and spring flex portion 24 is further deformed. In the fully inserted condition shown in FIG. 3, the contact member 18 engages the final contact region 52 of the contact portion 26. The spring flex portion 24 is deformed so that a contact force significantly larger than the preload force is applied in a normal direction between the contact portion 26 and the contact member 18. The abutment portion 22 is spaced away from the opposed wall 42 due to resilient deformation of the spring flex portion 24.

Since the abutment portion 22 is spaced from the contact portion 26 in the axial direction (the direction of contact member insertion), the preload force and the larger contact force can be accurately tailored for the specific requirements of any connector and its intended use. In addition, the angle relative to the axial direction of the contact lead in portion 50 can be chosen to provide a low insertion force independent of the axial distance between the spring flex portion 24 and the abutment portion 22.

Figure 3:
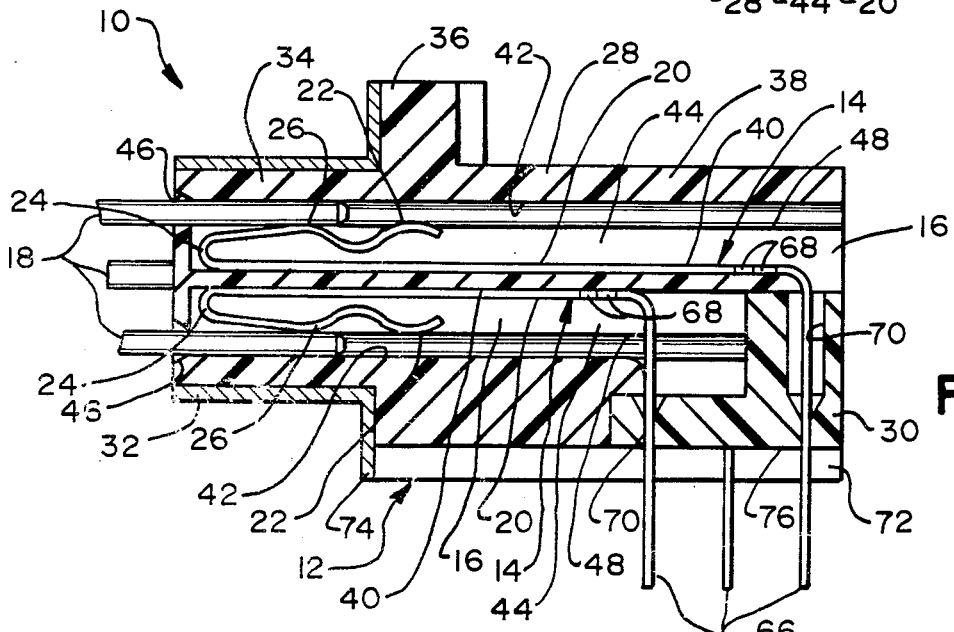
FIG. 3 is an elevational sectional view of the connector of FIG. 1 illustrating the connector with contact members inserted into the connector and contacted by the terminals of the present invention.

Since the contact portion 26 is normally or initially spaced from the opposed wall 42, the contact portion 26 need move in the transverse direction only a small distance between the initial or normal position of FIG. 4 and the fully inserted position of FIG. 3. As a result, a small amount of wiping action between an inserted contact member 18 and contact portion 26 is sufficient to create full electrical contact. While a degree of wiping action is desirable for reliable electric contact, it is also desirable to limit wiping action to prevent wear of the surface of contact portion 26 and/or contact member 18 which may be plated with a low resistance contact material such as gold.

With the terminal 14 of the present invention, low insertion forces may be achieved without undue reduction in normal contact forces. In addition, the ratio of insertion force to withdrawal force may be reduced to overcome difficulties with known preloaded terminals which may require high insertion forces yet do not provide sufficiently high forces preventing withdrawal of an inserted contact member.

We claim:

1. A preloaded spring contact electrical terminal adapted to be mounted in a connector housing cavity having a pair of opposed spaced-apart cavity walls extending axially from a cavity entrance through which a contact member is removably insertable to be electrically contacted by the termnal, said terminal comprising a unitary elongated strip of metal including a support portion fixedly positoned in said housing and extending in parallel engagement with a first of said cavity walls, an abutment portion engageable with the second wall overlying said support portion, spring flex portion disposed between said support portion at said abutment portion and adjacent said cavity entrance, said spring flex portion being deformed to provide a preload spring force of the abutment portion against the second wall and to provide a contact force larger than the preload force when the contact member is inserted, and a contact portion disposed intermediate said spring flex portion and the abutment portion and axially aligned therewith, said contact portion being spaced from the second cavity wall by a distance less than the width of the insertable contact member, the improvement comprising:

said contact portion including a flat lead-in section extending from said spring flex portion and ending in a final rounded portion said flat lead-in portion being disposed at an acute angle with respect to said support portion; and said abutment portion being rounded, said contact portion and said abutment portion being configured to provide a low insertion force terminal.

2. A terminal as in claim 1, said terminal including an external rearward righ angle lead portion extending from said support portion out of said housing at a location spaced from said cavity entrance adapted to electrically engage a printed circuit on a printed circuit board.

3. An electrical connector comprising a housing defining a cavity adapted to receive a conductive contact member inserted through an entry end of the cavity in an axial direction into the cavity, a terminal in said cavity for making electrical contact with an inserted contact member, said cavity including opposed transversely spaced apart axially extending first and second walls, and the improvement characterized by:

said terminal including an elongated, one-piece strip of metal formed to provide a support portion, a spring flex portion, a flat lead-in portion, a rounded electrical contact portion and a rounded preloaded aboutment portion;

said support portion engaging said first cavity wall;

said spring flex portion being adjacent said support portion and including an arcuate segment of said strip extending away from said first cavity wall and toward said second cavity wall;

said flat lead-in section extending between said spring flex portion and said rounded contact portion and disposed at an acute angle relative to the support portion;

said rounded abutment portion engaging said second cavity wall with a preload spring force resulting from said flexing of said spring flex portion;

said rounded contact portion being axially spaced from and axially aligned with said rounded abutment portion and being closer to said cavity entry than said rounded abutment portion;

said rounded contact and rounded abutment portions overlying said support portion; and said rounded contact portion being spaced from said second cavity wall for receiving an inserted contact member between the contact portion and said second cavity wall.

4. A multi-row high density receptacle connector of the D-subminiature type adapted to electrically connect pin terminals of a mateable D-subminiature plug connector to printed circuits on a printed circuit board, said receptacle connector comprising:

a unitary electriclaly insulative housing including a forward D-subminiature nose portion with a plurality of entrance openings, an intermediate flange portion and a rear portion with a plurality of openings, said housing further having a corresponding plurality of terminal-receiving cavities extending between said entrance opening and said rear opeings; said cavities disposed in said housing to define an upper, a middle, and a lower row of spaced-apart cavities, the cavities of said upper row and said lower row being aligned, the cavities of said middle row being offset with respect to the aligned cavities of the upper and the lower rows, each terminal receiving cavity being further defined by opposed spaced apart axially extending upper and lower sidewalls; and a plurality of unitary metallic strip terminals mounted in each cavity, each terminal including an intermediate support portion mounted in said housing, a rearward right angle lead portion extending outside of the rear portion of the housing adapted to electrically engage a printed circuit on a printed circuit board and a forward portion for making contact with an inserted pin terminal of a mated D-subminiature plug connector; said forward portion including greater than 90 degree bend of said strip defining s spring flex portion adjacent the support portion, and a flat lead in portion, a rounded contact portion and a rounded preload abutment portion, said flat lead in section extending between said spring flex portion and said rounded contact portion and disposed at an acute angle relative to said support portion; said rounded abutment portion engaging one said cavity sidewall with a preload force resulting from flexing of said spring flex portion; said rounded contact portion being axially spaced from and axially aligned with said rounded abutment portion and being closer to said cavity entrance opening than said rounded abutment portion; said rounded contact and rounded abutment portions overlying said support portion; and said rounded contact portion being spaced from said one cavity sidewall to engageably receive an inserted pin terminal between the contact portion and said one cavity sidewall; and said terminals in said upper row and said lower row of cavities being mounted in an opposite orientation relative to each other such that the support portions of the terminals in said upper row are disposed adjacent their respective lower cavity sidewalls and the support portions of the terminals in the lower row are disposed adjacent their respective upper cavity sidewalls, or vice versa, whereby a low insertion force, high density D-subminiature receptacle connector is provided.

* * * * *